US011585037B2

(12) United States Patent
Fletcher et al.

(10) Patent No.: US 11,585,037 B2
(45) **Date of Patent: *Feb. 21, 2023**

(54) DOSING DEVICE AND SYSTEM

(71) Applicant: Reckitt Benckiser Finish B.V., Hoofddorp (NL)

(72) Inventors: Henry Matthew Lawrence Fletcher, Cambridge (GB); Max William Middleton, Cambridge (GB); Colin Pryor, Boston, MA (US); Simon Burge, Cambridge (GB); Charles Kevin Dillon, Cambridge (GB); Iain Christopher Smith, Cambridge (GB); Mike Andrew Vilhauer, Cambridge (GB); Thomas Murray Fry, Cambridge (GB); Rosanna Elizabeth Parrish, Cambridge (GB); Jörg Peter Pflug, Heidelberg (DE); Kai Werner Heppert, Heidelberg (DE)

(73) Assignee: Reckitt Benckiser Finish B.V., Hoofddorp (NL)

( * ) Notice: Subject to any disclaimer, the term of this patent is extended or adjusted under 35 U.S.C. 154(b) by 269 days.

This patent is subject to a terminal disclaimer.

(21) Appl. No.: 16/464,953

(22) PCT Filed: Nov. 28, 2017

(86) PCT No.: PCT/EP2017/080630

§ 371 (c)(1),
(2) Date: May 29, 2019

(87) PCT Pub. No.: WO2018/099900

PCT Pub. Date: Jun. 7, 2018

(65) Prior Publication Data

US 2019/0307311 A1 Oct. 10, 2019

(30) Foreign Application Priority Data

Nov. 30, 2016 (GB) ..... 1620271

(51) Int. Cl.
*A47L 15/44* (2006.01)
*D06F 39/02* (2006.01)
*B65D 83/04* (2006.01)

(52) U.S. Cl.
CPC ..... *D06F 39/026* (2013.01); *A47L 15/449* (2013.01); *A47L 15/4472* (2013.01); *A47L 15/4463* (2013.01); *B65D 83/04* (2013.01)

(58) Field of Classification Search
CPC ..... B65D 83/04; B65D 83/0409; B65D 2583/04; B65D 2583/0459;
(Continued)

(56) References Cited

U.S. PATENT DOCUMENTS 3,178,915 A 4/1965 Hertel
8,651,336 B2 2/2014 Gadini et al.
(Continued)

FOREIGN PATENT DOCUMENTS

CN 1210167 A 3/1999
CN 101836964 A 9/2010
(Continued)

OTHER PUBLICATIONS

Machine Translation of Preugschas, EP-1159913-A1, Dec. 2001. (Year: 2001).*
(Continued)

*Primary Examiner* — David G Cormier
(74) *Attorney, Agent, or Firm* — Troutman Pepper Hamilton Sanders LLP; Ryan A. Schneider; Chris N. Davis

(57) ABSTRACT

A dosing device or system for dispensing tablets, which can include at least one active ingredient for an automatic washing process, into an automatic washing machine, wherein the dosing device or system is for dispensing one or more, but not all, of the tablets at once into the automatic
(Continued)

washing machine, and wherein the dosing device or system can be for dispensing only one tablet at once.

14 Claims, 2 Drawing Sheets

(58) Field of Classification Search
CPC .... B65D 2583/0472; B65D 2583/0477; B65D 2583/049; B65D 2583/0495; A47L 15/4463; A47L 15/4472; A47L 15/449; D06F 39/026
See application file for complete search history.

(56) References Cited

U.S. PATENT DOCUMENTS

| | | | | |
|---|---|---|---|---|
| 2002/0117511 | A1 | 8/2002 | McNabb et al. | |
| 2005/0045652 | A1 | 3/2005 | Maser | |
| 2007/0044819 | A1* | 3/2007 | Chan | A47L 15/449 134/18 |
| 2007/0210118 | A1 | 9/2007 | Gadini | |
| 2009/0266389 | A1 | 10/2009 | Classen et al. | |
| 2011/0139820 | A1 | 6/2011 | Kessler et al. | |
| 2011/0189061 | A1 | 8/2011 | Van Loyen et al. | |
| 2011/0266311 | A1 | 11/2011 | Nielsen | |
| 2011/0295416 | A1* | 12/2011 | Aquilonius | A61J 7/0481 221/98 |

FOREIGN PATENT DOCUMENTS

| | | | | |
|---|---|---|---|---|
| CN | 101854843 | A | 10/2010 | |
| CN | 101877992 | A | 11/2010 | |
| CN | 102186745 | A | 9/2011 | |
| CN | 102833996 | A | 12/2012 | |
| CN | 104264422 | A | 1/2015 | |
| CN | 104562561 | A | 4/2015 | |
| CN | 104631056 | A | 5/2015 | |
| CN | 105019196 | A | 11/2015 | |
| DE | 19540958 | A1 | 5/1997 | |
| DE | 19636417 | A1 | 3/1998 | |
| DE | 10058460 | A1 | 5/2002 | |
| EP | 0699595 | A1 | 3/1996 | |
| EP | 1159913 | A1 * | 12/2001 | D06F 39/026 |
| EP | 1493375 | A1 | 1/2005 | |
| EP | 2550850 | A1 | 1/2013 | |
| FR | 2641764 | A1 | 7/1990 | |
| GB | 2257421 | A | 1/1993 | |
| JP | 2010136795 | A | 6/2010 | |
| RU | 2011105425 | A | 8/2012 | |
| RU | 2012147806 | A | 5/2014 | |
| WO | 9701157 | A1 | 1/1997 | |
| WO | 02058528 | A1 | 8/2002 | |
| WO | 2003093560 | A1 | 11/2003 | |
| WO | 2004098371 | A2 | 11/2004 | |
| WO | 2011128672 | A2 | 10/2011 | |

OTHER PUBLICATIONS

European Examination and Search Report issued in GB1620271.5 dated May 22, 2017.
International Search Report and Written Opinion issued in PCT/EP2017/080630 dated Feb. 19, 2018.
European Search and Examination Report issued in GB1620268.1 dated May 22, 2017.
International Search Report and Written Opinion issued in PCT/EP2017/080628 dated Mar. 16, 2018.
Machine translation of Preugschas, EP1159913A1, Dec. 2001.
European Examination and Search Report issued in GB1620264.0 dated May 22, 2017.
International Search Report and Written Opinion issued in PCT/EP2017/080625 dated Feb. 26, 2018.
Chinese Office Action dated Jan. 17, 2022.
Chinese Search Report dated Jan. 11, 2022.
Examination Report No. 1 for Australian Patent Application No. 2017368214 dated Dec. 1, 2022.

* cited by examiner

DOSING DEVICE AND SYSTEM

The present invention relates to a dosing device or system. The invention especially relates to a dosing device or system for reliably dispensing tablets of active ingredient into an automatic washing machine, such as a dishwasher or a laundry washing machine, multiple times over multiple washing cycles.

BACKGROUND RELATING TO THE PRIOR ART

Most commercially available domestic dishwashers have a detergent dispenser which the consumer loads with a single dose of detergent before each wash program. However, a developing area of interest in this field has been the provision of a means to store multiple doses of detergent and deliver them automatically during each successive wash program.

Devices that have been previously disclosed in this area generally fall into the categories of "machine-independent" or "machine-dependent". Machine-independent devices are ones which are not physically connected to the dishwasher's electronics or powered directly by its power source. They can be freely positioned inside the dishwasher, for instance in the rack, so they are not particularly limited by spatial constraints in their design. On the other hand, in order to trigger a dosing step at the appropriate time, they should be designed to respond to sensed parameters of the wash, such as heat, turbidity, etc., which does not always provide a very accurate control mechanism. Conversely, machine-dependent devices are generally connectable to the dishwasher in a predetermined location, and can take their control signals and power from the dishwasher itself. This can lead to more accurate control of when dosing takes place, but brings its own constraints on device design. For instance, a convenient, accessible location to connect such a device is in the door of the dishwasher, but there is limited space in this area, so more attention should be paid to making this type of device as compact and slim as possible. Such machine-dependent devices are the primary focus of the present inventors.

It is known that dosing devices can supply active ingredients to the wash in the form of powders or liquids. However, not all active ingredients can be suitably provided in a liquid composition, whereas powders are liable to suffer from dispensing issues due to moisture intake from the humid washing environment, e.g. swelling or becoming sticky, especially when stored in a container inside an automatic washing machine. It is also known that dosing devices can instead supply tablets to the wash, generally hard tablets formed of compressed powder. The device needs to store multiple tablets and dose one or more individual ones per wash program as required. For effective dosing, it is important to ensure that tablets do not become wedged against each other inside the device. This is a particular challenge for tablets having a flat face, whilst spherical ones can be more difficult to manufacture.

An example of a machine-dependent dosing device is disclosed in EP 1,355,561. In this prior art dosing device, there is provided a rotating disc which can control the delivery of spherical or cylindrical tablets from a container into the main wash tank of a dishwasher. The tablets are pre-sorted and pre-orientated into columns inside the container, with curved surfaces of the tablets touching and guides physically separating the tablets in different columns to restrict their movement.

A further prior art dosing device for a dishwasher is disclosed in EP 1,159,913. The main portion of this dosing device is located outside the dishwasher, free from space constraints, and a long delivery tube feeds the dosed tablets down inside the machine to the bottom of the main tank. The main body of the device accommodates a loose filling of tablets and has a rotating disc to meter tablets into the dishwasher. However, the tablets are preferably fed to the disc from the bulk via a feed chute accommodating a single column of tablets, which in turn is fed by a conveyor device. In this prior art dosing device, the conveyor device aligns the tablets such that they are all fed into the rotating disc in the same orientation. In this way, jams inside the dosing device are reduced.

Both these devices are bulky and awkward to manufacture; attempts to decrease their size have led to increasing jamming issues.

SUMMARY OF THE INVENTION

According to a first aspect of the present invention, there is provided a dosing device or system for dispensing a plurality of tablets, which each comprise at least one active ingredient for an automatic washing process, into an automatic washing machine, wherein the dosing device or system is for dispensing one or more, but not all, of the plurality of tablets at once into the automatic washing machine, wherein the dosing device or system comprises:

- a container for storing the plurality of tablets, wherein the container comprises an exit port;
- an outlet for delivering the one or more tablets from the container into the automatic washing machine;
- a metering mechanism located between the exit port of the container and the outlet, wherein the metering mechanism comprises a wheel which is rotatable between a first position, in which the one or more tablets are receivable from the exit port, and a second position in which the one or more tablets are deliverable to the outlet; and
- a housing defining a cylindrical space in which the wheel is positioned, wherein the cylindrical space comprises a longitudinal axis;
- wherein the cylindrical space of the housing comprises an inlet opening extending in a first direction for receiving the one or more tablets from the exit port of the container, and an output opening for delivering the one or more tablets to the outlet;
- wherein the rotation axis of the wheel is substantially parallel to the longitudinal axis, and wherein the rotation axis of the wheel is substantially transverse the first direction;
- wherein the separation between the wheel and the inlet opening is maximised when the wheel is in the first position, and wherein the separation between the wheel and the output opening is maximised when the wheel is in the second position.

According to a second aspect of the present invention, there is provided a cartridge comprising one or more dosing devices according to the invention in its first aspect, comprising a plurality of tablets inside the or each container, each tablet comprising at least one active ingredient for an automatic washing process.

According to a third aspect of the present invention, there is provided a kit comprising an automatic washing machine and at least one cartridge according to the invention in its second aspect.

According to a fourth aspect of the present invention, there is provided an automatic washing machine comprising a device or system comprising an outlet, metering mechanism and housing each as defined in the first aspect of the invention, wherein the device or system is configured to connect with a container to form a dosing system according to the invention in its first aspect, wherein the container comprises an exit port and a plurality of tablets inside the container, each tablet comprising at least one active ingredient for an automatic washing process.

Embodiments described herein in relation to one aspect of the invention apply equally to other aspects of the invention unless specified to the contrary or the context otherwise requires.

DETAILED DESCRIPTION

Figures 1A, 1B:
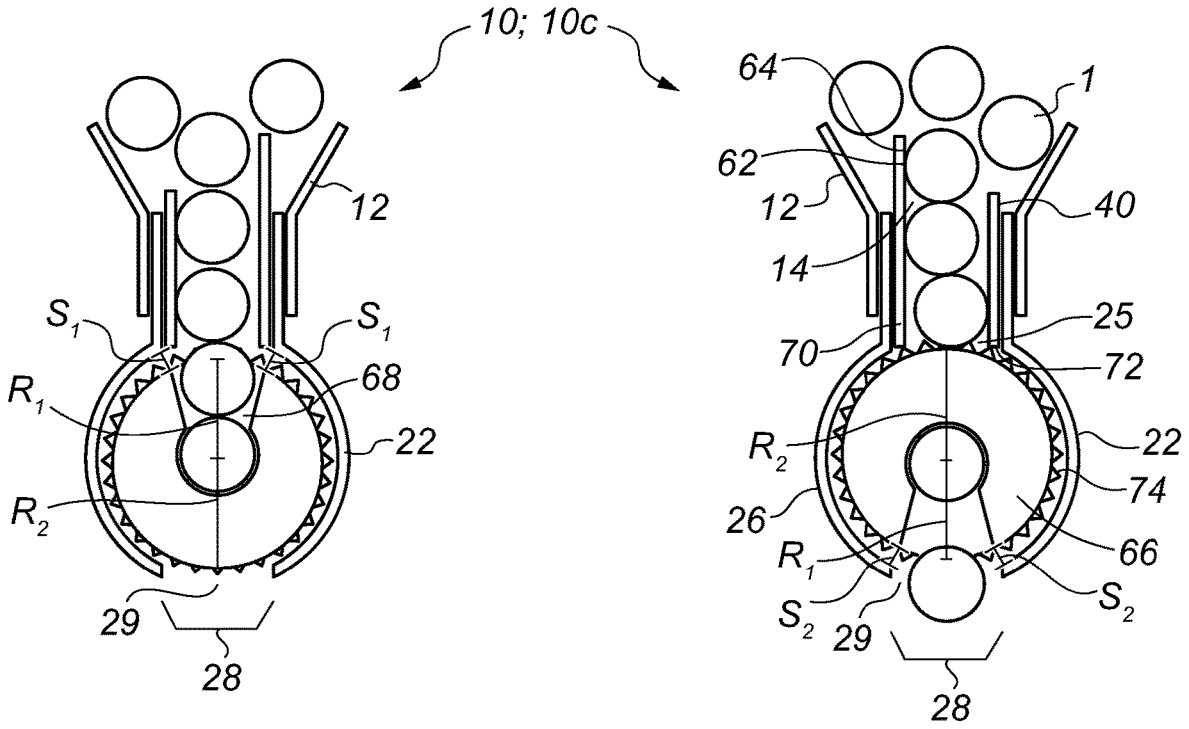
FIG. 1*a* shows a schematic cross-sectional view of an embodiment of a dosing device according to the invention in a first, closed, position.
FIG. 1*b* shows a schematic cross-sectional view of this dosing device in a second, open, position.

The device or system of the present invention may advantageously be made less bulky than the prior art devices and systems without suffering jamming issues as its size decreases. By maximising the separation between the wheel and the inlet/output openings as described herein, the likelihood of a tablet becoming stuck, or getting jammed, as it passes through these openings is reduced.

Preferably the wheel comprises at least one recess for receiving the one or more tablets. The inlet opening and the output opening may be diametrically opposed one another inside the cylindrical space. In an embodiment, the wheel comprises two or more tablet-receiving recesses, such that the wheel rotates through a smaller angle for each dispensing step.

Preferably, each recess holds one tablet only.

In an embodiment, the wheel comprises at least two radially projecting spokes, wherein a tablet is receivable between the two spokes.

The wheel may comprise a plurality of teeth, which may extend around the circumference of the wheel. Rotation of the wheel may be driven by a motor.

In use of the dosing device or system, tablets which are located in the container are preferably fed by gravity towards the metering mechanism. In this way, the need for a separate mechanism to feed tablets inside the container towards the metering mechanism is removed. The metering mechanism may have a sloping surface at an end adjacent the exit port, along which a tablet can slide.

In an embodiment, the dosing device or system comprises a tube for delivering tablets from the exit port of the container towards the inlet opening of the housing. Preferably, the tube is sized such that tablets are delivered one at a time to the inlet opening.

In an embodiment, the dosing device or system comprises an agitation means which is moveable by the wheel, to agitate tablets in the vicinity of the exit port. This reduces the chance of them becoming wedged against each other or against the sides of the exit port and thereby blocking the exit port. When the dosing device or system comprises an agitation means, and when the dosing device comprises a plurality of teeth, the agitation means may be engageable against the plurality of teeth. When the dosing device or system comprises the above-described tube, the tube may be rotatable in concert with the wheel, and the top surface of the tube may be located around the exit port and may comprise a crenelated portion which acts as the agitation means. A plurality of crenelations may each define a geometric shape, such as a triangle, a rectangle, or a semi-circle.

Preferably, a maximum width of the agitation means is no more than four times, more preferably no more than three times, a maximum diameter of the exit port. In this way, the size of the agitation means can be restricted so as to not occupy a large amount of space inside the container.

In the invention, the container, metering mechanism and housing may all be located in a cartridge for connection to an automatic washing machine. Alternatively, the metering mechanism and housing may already be located in an automatic washing machine, and the container is a separate product to be connected in the appropriate position. The cartridge or container may be connected to the automatic washing machine via a suitable interface.

The cartridge, dosing device or system may be made of any suitable materials. Preferably, at least the container is made of a plastics material and/or is thermally insulated, to prevent heat damage to the tablets inside. Preferably, the container converges towards the metering mechanism. For example, it may be funnel shaped.

Preferably, the dosing device or system is configured to dispense only one tablet at a time.

In an embodiment, the cartridge, dosing device or system has no internal electrical power source, e.g. no battery. In an embodiment, the cartridge, dosing device or system is electrically connected to the automatic washing machine.

The cartridge, dosing device or system need not comprise any temperature, turbidity, conductivity and/or water sensor. It may comprise no sensors at all. It may be controlled based on signals from such sensors found elsewhere in the automatic washing machine. This simplifies its construction and reduces its cost.

The tablets comprise one or more active ingredients for an automatic washing process. As will be appreciated by the skilled person, the nature of the active ingredient(s) used in the tablets will vary depending on the desired application. When used inside a dishwasher, the tablets may, for example, comprise an active ingredient performing a dishwasher detergent, rinse aid, machine cleaner or dishwasher deodorizing function. In the context of laundry washing machines, the tablets may, for example, comprise an active ingredient performing a laundry detergent or fabric softener function. Suitable active ingredients will be known to the skilled person; examples include bleach, bleach activator, bleach catalyst, enzyme, surfactant, builder, pH-adjusting agent, corrosion inhibitor, and fragrance.

Advantageously, each tablet contains a unit dose of the active ingredient, i.e. the entire amount of the active ingredient desired to be used in the washing process, such that only one tablet of that active ingredient needs to be dispensed per washing process (though multiple dosing devices or systems may still be used to dispense multiple tablets of different active ingredients per washing process). In other embodiments, it may be an advantage for the unit dose of the active ingredient to be provided by more than one tablet. For example, in some cases a single tablet containing the entire unit dose may be rather large or heavy, and dosing may be more effective or reliable using multiple smaller or lighter tablets. Preferably, the desired dose of the active ingredient is provided by no more than 10 tablets, preferably no more than 9, 8, 7, 6, 5, or 4 tablets. Preferably, the unit dose is provided by 1, 2, 3 or 4 tablets, in an embodiment 3 or 4 tablets.

Another useful option is to provide tablets each of which contains an amount of active ingredient that corresponds to no more than one unit dose of the active ingredient for at least one washing process of the automatic washing machine. Some automatic washing machines are configured to allow selection between various different modes of operation, such as an intensive wash program and a light wash program, which require different amounts of the active ingredient. Thus, a number of tablets may be dosed during one mode of operation and a different number of tablets are dosed during a different mode of operation. For example, one tablet may be dosed during a wash program for a certain soiling level and two tablets during a wash program designed for a higher level of soiling.

The tablets may be of any suitable form, such as solid, gel tab, or water soluble package/container (preferably of low deformability). Preferably, at least the exterior of the tablets are solid. For example, a capsule of a dissolvable (preferably hard) shell material could enclose a powder, liquid or gel composition. Advantageously, however, the tablets are formed of a compressed powder. Each tablet may, for example, be single phase or multi-layered, and may be otherwise structured to ensure that each active ingredient is released from the tablet at the most optimal time. The tablets may be wrapped in a film of water-soluble material, but preferably they are unwrapped. They may be coated with a suitable coating, e.g. to reduce friability.

The tablets may be of any suitable shape, such as cylindrical, disc-shaped, spherical, spheroidal, or cuboid. In an embodiment, each tablet has at least one flat face. Preferably the tablets are cylindrical or disc-shaped, since spherical tablets are more difficult to manufacture whilst shapes such as cuboid are less easily dispensed. In the case of a cylindrical tablet, preferably the length of the tablet is up to 5% more or less than the diameter of the tablet. When the tablet has edges, preferably at least some of these edges are chamfered and/or filleted to reduce the liability to chip during manufacture and whilst the tablet is in the dosing device. Preferably the chamfer has an angle of 15 to 20 degrees.

In an embodiment, each tablet has a weight of: at least 0.1 g, at least 0.5 g, at least 0.7 g, at least 1 g, at least 1.2 g, at least 1.5 g, at least 2 g, at least 3 g, at least 4 g, or at least 5 g; and/or up to 15 g, up to 14 g, up to 13 g, up to 12 g, up toll g, up to 10 g, up to 9 g, up to 8 g, up to 7 g, or up to 6 g. In an embodiment, each tablet has a maximum length and/or diameter of: at least 5 mm, at least 6 mm, at least 7 mm, at least 8 mm, at least 9 mm, or at least 10 mm; and/or up to 20 mm, up to 19 mm, up to 18 mm, up to 17 mm, up to 16 mm, or up to 15 mm.

Preferably, the tablets are loosely filled into the container. Preferably, they are randomly oriented therein. The maximum dimension of each tablet may be, for example, less than ⅔ of, or less than half of, the width of the exit port. Thus, in an embodiment, there is plenty of room for the tablets to be agitated in the vicinity of the exit port.

The cartridge of the second aspect of the invention comprises one or more of the inventive dosing devices, and a plurality of tablets inside the or each container. The third aspect of the invention provides a kit of at least one of these cartridges and an automatic washing machine.

Advantageously, the invention allows the dispensing of different tablets into the automatic washing machine separately. Different tablets may need to be stored separately due to incompatibility, or may be more effective if dispensed at different times during a single wash process, or may be adapted to different types of wash programs. For example, it may be advantageous to dose a bleach-containing tablet separately from an enzyme-containing tablet. It may also be desirable to dose a tablet containing a high level of an active ingredient during an intensive wash program for heavily soiled items, but a tablet containing a lower level of an active ingredient during a lower intensity wash program for more lightly soiled items.

In an embodiment, the cartridge comprises at least two of the inventive dosing devices. Alternatively or in addition, two or more cartridges may be provided in a kit. Preferably, the tablets inside the container of a first dosing device are different from the tablets inside the container of a second dosing device. The tablets may differ in the type of active ingredient(s) included, or in the amount of active ingredient(s), or in another respect. The operation of the first dosing device is preferably independent from the operation of the second dosing device.

Each container may be refillable with tablets, or may be single-use such that when a container runs out of tablets, it is disposed of.

An automatic washing machine may be provided with a dosing device of the invention or a system comprising two or more dosing devices of the invention. Preferably, the dosing devices can be operated independently.

The automatic washing machine may be, for example, a dishwasher or a laundry washing machine. Preferably, it is a dishwasher, preferably a domestic dishwasher. In an embodiment, it is a dishwasher having a single tank. Preferably, the dishwasher does not operate on a conveyor system, i.e. the dishes remain stationary during the wash rather than being moved through one or more tanks. Preferably, the dishwasher has a main wash space which is closed by a door. In an embodiment, the cartridge, dosing device or system is located at least partially inside the main wash space during use, for example it may be partially embedded in a wall and partially projecting into the main wash space during use, or it may be attached to a wall of the main wash space. In an embodiment, the outlet of the dosing device or system delivers the tablets directly into the main wash space.

In an embodiment, the inventive cartridge, dosing device or system connects to the automatic washing machine in a predetermined location of the automatic washing machine. The connection may be via an interface. In the case of a dishwasher, preferably the inventive cartridge, dosing device or system connects to the dishwasher via an interface in a door of the dishwasher. The interface may comprise electrical and/or optical connections to transfer power and/or control signals between the automatic washing machine and the cartridge, dosing device or system.

Preferably, the automatic washing machine has a controller which controls the operation, and dispensing of tablets from, the container(s).

Also disclosed herein is a method of dispensing tablets into an automatic washing machine, using a dosing device or system according to the invention, comprising moving the wheel from the first position to the second position and metering at least one tablet into the automatic washing machine. In an embodiment, at least one tablet is dispensed directly into a main wash space of the automatic washing machine. Preferably, at least one tablet is dispensed during a main wash cycle of a dishwasher. Alternatively or in addition, at least one tablet may be dispensed during a rinse cycle of the dishwasher.

Preferred embodiments of the invention will now be described further with reference to the accompanying Figures.

With reference to FIGS. 1*a* and 1*b*, there is shown an embodiment of a dosing device 10; 10*c* for administering tablets 1 into an automatic washing machine. At its top end, the dosing device 10 comprises a container 12 containing a plurality of tablets (not shown). The bottom of the container 12 is funnel shaped and converges towards an exit port 14 of the container 12. This dosing device 10; 10*c* also comprises a metering mechanism having a wheel 66, a housing 22, an outlet 29, and an agitation means 40. This dosing device 10; 10*c* is operable to move between a first position as shown in FIG. 1*a* and a second position as shown in FIG. 1*b*.

The wheel 66 is rotatable inside the housing 22 and comprises a recess 68 in which a tablet 1 from the container 12 is operable to be held during rotation of the wheel 66 inside the housing 22 from the first position to the second position. In this dosing device 10*c*, the cylindrical housing 22 is horizontally orientated such that it defines a space in which the wheel 66 is operable to rotate inside the housing 22 about a substantially horizontal axis.

The inlet opening 25 from this dosing device 10*c* is located in an uppermost portion of the horizontal side wall 26 of the housing 22. The output opening 28 is located in a lowermost portion of the horizontal side wall 26, and in a position which is diametrically opposed from the inlet opening 25 inside the housing 22.

In the first position of the metering mechanism, the recess 68 from the wheel 66 faces upwards and is in communication with the inlet opening 25 of the housing 22 (as shown in FIG. 1*a*). Upon rotation of the wheel 66 to the second position of the metering mechanism, in this second position the recess 68 from the wheel 66 faces downwards and is in communication with the output opening 28 of the housing 22 and the outlet 29 of the dosing device 10*c* (as shown in FIG. 1*b*).

The radius of the wheel 66 is not uniform around its circumference, such that the radius (R1) of the wheel is at a minimum at the angular position of the recess 68, and is at a maximum (R2) at the angular position which is diametrically opposed the recess 68. As a result of this varying radius, the wheel 66 defines an eccentric shape such that as it rotates inside the housing 22, the separation (S1) between the wheel 66 and the inlet opening 25 is maximised when the wheel is in the first position (i.e. when the recess is in communication with the inlet opening 25), and the separation (S2) between the wheel 66 and the output opening 28 is maximised when the wheel is in the second position (i.e. when the recess 68 is in communication with the output opening 28).

By providing a small amount of additional clearance between the recess 68 at the points where it is in communication with either of the inlet opening 25 and the output opening 28, this additional clearance helps guide a tablet 1 into the recess 68, such that the likelihood of a tablet 1 becoming stuck, or getting jammed, inside the metering mechanism during its operation is reduced.

The dosing device 10*c* comprises a tube 70 for delivering a tablet 1 from the exit port 14 of the container 12 down towards the inlet opening 25 of the housing 22.

The agitation means 40 from this dosing device 10*c* is defined by a crenelated portion 62 added to the top surface of the tube 70. The top surface of the tube 70, which is located around the exit port 14 of the container 12, comprises a plurality of crenelations 64 each defining a geometric shape, such as a triangle, a rectangle, or a semi-circle.

The bottom of the tube 70 comprises a series of teeth 72 which engage with corresponding teeth 74 extending around the circumference of the wheel 66. Since the bottom of the tube 70 comprises teeth 72 which engage with the corresponding teeth 74 on the wheel 66, as the wheel 66 rotates during use of the dosing device 10*c*, the crenelations 64 on the top surface of the tube 70 linearly oscillate up and down, and also rotate around the exit port 14 from the container 12 to agitate tablets in the vicinity of the exit port 14.

The dosing device 10; 10*c* is operable to dispense at least one tablet into a dishwasher during a wash cycle of the automatic washing machine. Preferably, for each movement of the wheel 66 from the first position to the second position, the dosing device 10 is configured to dispense a single tablet from the container 12 to the outlet 29 of the dosing device.

Movement of the wheel 66 between its first and second positions is controlled using a motor (not shown in the Figures) which is connected to the metering mechanism. Operation of the motor is governed by commands sent from a controller located in the automatic washing machine. For a given wash cycle, the controller is configured to instruct the motor to move the metering mechanism between its first and second positions, such that one or more tablets are dispensed by the dosing device 10 into the machine at different times during the wash cycle.

Figure 2:
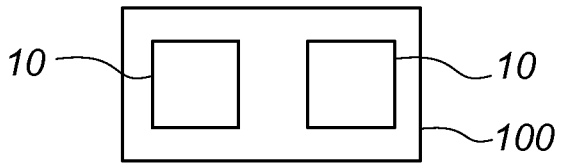
FIG. 2 shows a schematic view of a dosing system according to an embodiment of the invention.

It will be appreciated that by having a plurality of dosing devices 10 arranged in parallel, a dosing system 100 can be provided as shown in FIG. 2. With such a dosing system 100, the dosing devices 10 can be filled with tablets 1 of different active ingredients. In this way, and by having each dosing device 10 individually controlled by the controller, the dosing system can dispense different tablets at different times.

Figure 3:
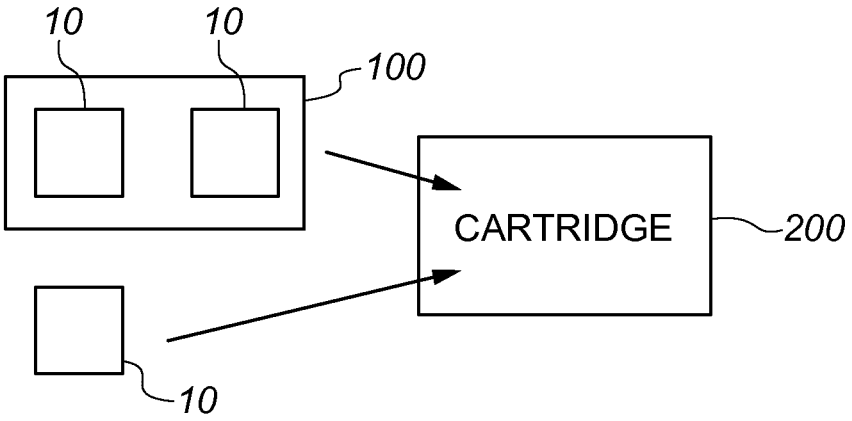
FIG. 3 shows a schematic view of a cartridge according to an embodiment of the invention.

It will also be appreciated that any number of dosing devices 10 and/or dosing systems 100 can be supplied as a cartridge 200, as shown in FIG. 3. The cartridge 200 may either be refillable such that each container 12 therein may be refilled with tablets 1, or the cartridge 200 may be single-use such that when a container 12 runs out of tablets 1, the cartridge 200 is disposed of.

Figure 4:
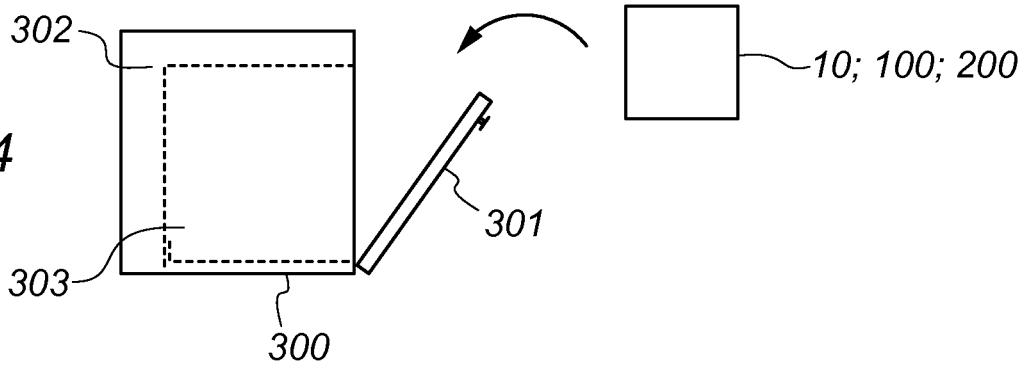
FIG. 4 shows a schematic view of a dishwasher according to an embodiment of the invention.

The dosing device 10, dosing system 100, and cartridge 200 described herein are preferably intended to be connected to, and communicate with a controller located in, a dishwasher 300 as shown in FIG. 4. Possible connection points for the dosing device 10; dosing system 100; or cartridge 200 inside the dishwasher 300 include the door 301, the main housing 302, or the interior wash space 303 of the dishwasher 300, though the door 301 is most preferred for easy accessibility.

Although the dosing device, dosing system, and cartridge of the invention have been described above as being useable with a dishwasher, it is appreciated that they may also be used to administer tablets into other automatic washing machines, such as a laundry washing machine. In this case, the dosing device 10 (or dosing system 100/cartridge 200) would connect to, and communicate with a controller, and a motor, located in the laundry washing machine. When the dosing device 10 is connected with a laundry washing machine, a tablet may advantageously be operable to pass from the outlet 29 of the dosing device 10 into a water tank of the laundry washing machine, such that the tablet can be dissolved into a solution of the active ingredient, which may be then fed, by a pump, into the drum of the machine.

In this way, during operation of the dosing device 10 in a given wash cycle in the laundry washing machine, the controller would be configured to instruct the motor to move the metering mechanism of the dosing device 10 between its first and second positions, such that one or more tablets can be dispensed into the laundry washing machine at different times during the wash cycle.

It will also be appreciated that rather than have all of the components from the dosing device 10 located in a cartridge 200 or all in an automatic washing machine, the components from the dosing device 10 may be distributed between the cartridge and the automatic washing machine. For example, in one configuration the cartridge 200 may be arranged to house the container 12 together with its tablets 1, and the automatic washing machine arranged to support the metering mechanism, the housing 22, and the outlet 29. When the cartridge 200 is inserted into the automatic washing machine, the components from the dosing device 10 would then connect up to form the dosing device 10 as described and shown herein.

The invention claimed is:

1. A dosing device comprising:

a container for storing tablets and comprising an exit port;

an outlet configured to deliver tablets from the container into an automatic washing machine;

a metering mechanism comprising a wheel with a rotation axis, rotatable between a first position and a second position, and located between the exit port of the container and the outlet, the wheel comprising a plurality of teeth extending around the circumference of the wheel;

an agitation portion movable by the wheel to agitate one or more tablets in the vicinity of the exit port, the agitation portion comprising a crenelated portion which extends into the container; and a housing defining a cylindrical space in which the wheel is positioned, wherein the cylindrical space comprises a longitudinal axis, an inlet opening extending in a first direction for receiving one or more tablets from the exit port of the container, and an output opening for delivering one or more tablets to the outlet;

wherein the rotation axis of the wheel is substantially parallel to the longitudinal axis of the cylindrical space of the housing, and wherein the rotation axis of the wheel is substantially transverse the first direction;

wherein in the first position, the metering mechanism receives one or more tablets from the exit port of the container;

wherein in the second position, the metering mechanism delivers one or more tablets to the outlet;

wherein a separation between the wheel and the inlet opening is maximized when the wheel is in the first position, and wherein a separation between the wheel and the output opening is maximized when the wheel is in the second position; and wherein the agitation portion is engageable against the plurality of teeth.

2. The dosing device according to claim 1, wherein the wheel comprises at least one recess for receiving one or more tablets.

3. The dosing device according to claim 1, wherein the wheel comprises at least two radially projecting spokes;

wherein one or more tablets are receivable between the two spokes.

4. The dosing device according to claim 1, wherein the inlet opening and the output opening are diametrically opposed one another inside the cylindrical space.

5. The dosing device according to claim 1, wherein the container converges towards the metering mechanism.

6. The dosing device according to claim 1, which is configured to allow tablets to be fed by gravity from the container towards the metering mechanism.

7. A cartridge comprising:

the dosing device according to claim 1; and tablets inside the container;

wherein each tablet comprises at least one active ingredient for an automatic washing process.

8. A kit comprising:

an automatic washing machine; and the cartridge according to claim 7.

9. The dosing device according to claim 1, wherein the dosing device is further configured to dispense one tablet at a time.

10. The cartridge according to claim 7, wherein one or more of the tablets have a cylindrical shape.

11. The cartridge according to claim 7, wherein one or more of the tablets have a disc shape or discoid shape.

12. A cartridge comprising:

a first dosing device according to claim 1;

first tablets inside a first container;

a second dosing device according to claim 1; and second tablets inside a second container;

wherein each of the first and second tablets comprises at least one active ingredient for an automatic washing process; and wherein the first tablets are different than the second tablets.

13. An automatic dishwashing machine connected with a dosing device, wherein the dosing device comprises:

a container comprising an exit port and tablets comprising at least one active ingredient for an automatic dishwashing process;

an outlet configured to deliver tablets from the container into the automatic dishwashing machine;

a metering mechanism comprising a wheel with a rotation axis, rotatable between a first position and a second position, and located between the exit port of the container and the outlet, the wheel comprising a plurality of teeth extending around the circumference of the wheel;

an agitation portion movable by the wheel to agitate one or more tablets in the vicinity of the exit port, the agitation portion comprising a crenelated portion which extends into the container; and a housing defining a cylindrical space in which the wheel is positioned, wherein the cylindrical space comprises a longitudinal axis, an inlet opening extending in a first direction for receiving one or more tablets from the exit port of the container, and an output opening for delivering one or more tablets to the outlet;

wherein the rotation axis of the wheel is substantially parallel to the longitudinal axis of the cylindrical space of the housing, and wherein the rotation axis of the wheel is substantially transverse the first direction;

wherein in the first position, the metering mechanism receives one or more tablets from the exit port of the container;

wherein in the second position, the metering mechanism delivers one or more tablets to the outlet;

wherein a separation between the wheel and the inlet opening is maximized when the wheel is in the first position, and wherein a separation between the wheel and the output opening is maximized when the wheel is in the second position; and wherein the agitation portion is engageable against the plurality of teeth.

14. An automatic dishwashing machine connected with a container, wherein the container comprises an exit port and tablets comprising at least one active ingredient for an automatic dishwashing process, and wherein the automatic dishwashing machine comprises:

an outlet configured to deliver tablets from the container into the automatic dishwashing machine;

a metering mechanism comprising a wheel with a rotation axis, rotatable between a first position and a second position, and located between the exit port of the container and the outlet, the wheel comprising a plurality of teeth extending around the circumference of the wheel;

an agitation portion movable by the wheel to agitate one or more tablets in the vicinity of the exit port, the agitation portion comprising a crenelated portion which extends into the container; and a housing defining a cylindrical space in which the wheel is positioned, wherein the cylindrical space comprises a longitudinal axis, an inlet opening extending in a first direction for receiving one or more tablets from the exit port of the container, and an output opening for delivering one or more tablets to the outlet;

wherein the rotation axis of the wheel is substantially parallel to the longitudinal axis of the cylindrical space of the housing, and wherein the rotation axis of the wheel is substantially transverse the first direction;

wherein in the first position, the metering mechanism receives one or more tablets from the exit port of the container;

wherein in the second position, the metering mechanism delivers one or more tablets to the outlet;

wherein a separation between the wheel and the inlet opening is maximized when the wheel is in the first position, and wherein a separation between the wheel and the output opening is maximized when the wheel is in the second position; and wherein the agitation portion is engageable against the plurality of teeth.

* * * * *